US008650669B1

(12) United States Patent
Kolter

(10) Patent No.: US 8,650,669 B1
(45) Date of Patent: Feb. 18, 2014

(54) PORTABLE URINAL

(76) Inventor: James Kolter, Phoenixville, PA (US)

( * ) Notice: Subject to any disclaimer, the term of this patent is extended or adjusted under 35 U.S.C. 154(b) by 137 days.

(21) Appl. No.: 13/373,851

(22) Filed: Dec. 2, 2011

(51) Int. Cl.
*A47K 11/00* (2006.01)

(52) U.S. Cl.
USPC ..... 4/144.1; 4/144.3

(58) Field of Classification Search
USPC ..... 4/144.1, 144.3
See application file for complete search history.

(56) References Cited

U.S. PATENT DOCUMENTS

| | | | | |
|---|---|---|---|---|
| 3,703,731 A | | 11/1972 | Leiser | 4/110 |
| 4,683,598 A | * | 8/1987 | Jones | 4/144.1 |
| 5,010,599 A | | 4/1991 | Nilsson | 4/144.2 |
| D357,979 S | | 5/1995 | Evans et al. | D24/122 |
| 6,021,530 A | * | 2/2000 | Davis | 4/144.3 |
| 6,021,531 A | | 2/2000 | Kirko | 4/144.3 |
| 6,041,448 A | | 3/2000 | Rempe et al. | 4/144.1 |
| 6,212,691 B1 | | 4/2001 | Heberer | 4/144.1 |

OTHER PUBLICATIONS

Web Page, Nov. 10, 2011, www.grainger.com/Grainger/Flexible Elbow flexible pipe.
Web Page, Nov. 10, 2011 Htp.//shop. advance autoparts.com/webapp/wcs/stores/servlet/product_Oil-Flex-spout-rhimo gear oil flex spout.

* cited by examiner

*Primary Examiner* — Tuan N Nguyen
(74) *Attorney, Agent, or Firm* — Woodcock Washburn LLP

(57) ABSTRACT

A portable urinal is provided with a reservoir having a low center of gravity, a flexible corrugated hose which will maintain its position in either a contracted or expanded condition or a shape or curve to which it is placed for convenience in use wherein the flexible corrugated hose maintains its shape and degree of extension or contraction and including receptacles suitable for use by males and females in various positions including seated, standing and stooping.

9 Claims, 5 Drawing Sheets

PORTABLE URINAL

FIELD OF THE INVENTION

The present invention relates to a portable urinal. More particularly, the present invention relates to a portable urinal usable by both a male and a female. wherein a corrugated hose is provided such that it provides the desired length of hose without coiling of extra hose material.

BACKGROUND OF THE INVENTION

There has been a long felt need for a portable urinal which is usable by both males and females in various locations. The need arises with respect to people having frequency, urgency or merely not having access to suitable toilet facilities for extended periods of time. Some of the people that may not have access to toilet facilities include pilots, people traveling, and incapacitated persons. Furthermore, a suitable portable urinal is often desired for convenience.

SUMMARY OF THE INVENTION

The present invention provides the advantage of a portable urinal.

Furthermore, the present invention provides an advantage of a portable urinal which is stable, easily positioned and which may be conveniently utilized where the reservoir container needs to be placed at various distances from the point of urination.

The present invention enables length of adjustment of a flexible hose with no excess hose which may coil or loop and cause problems including those of retention of urine within a loop of the coiled hose.

The present invention provides a corrugated hose which maintains its selected desired length for the duration of the urination.

The portable urinal of the present invention enables storage of urine in a stable container.

Another advantage of the present invention is that the user is able to see at a glance the absence of urine or the amount of urine contained within the reservoir container.

Briefly and basically, in accordance with the present invention, there is provided a reservoir container for holding urine. The reservoir container is provided with a low center of gravity when it contains urine. An input opening is provided on an upper portion of the reservoir container. A handle is also provided on the reservoir container for ease of positioning and transport. The input of the reservoir container is provided with a means for sealing the input. The portable urinal includes a corrugated hose with a first end and a second end. The corrugated hose is flexible, extendable and contractible and each corrugation of the corrugated hose is releasably lockable in a contracted condition and is releasably lockable in an extended condition. In this manner, the hose may be adjusted by placing each corrugation in a desired locked condition to provide the desired hose length. A first end of the corrugated hose is releasably attachable to the input of the reservoir container when the means for sealing the input is not on the input. The second end of the corrugated hose is attachable to a receptacle for receiving urine from a human being. The receptacle is shaped for either receipt of urine from a male or a female. The reservoir container is constructed of an opaque plastic material except for a vertically arranged elongated transparent area along a sidewall of the reservoir container for viewing the absence or the amount of urine in the reservoir container.

In a presently preferred embodiment, the corrugated hose may be releasably lockable in a contracted or expanded condition for a portion of the circumference of each corrugation, that is for a radial section of the hose, thereby enabling the formation of the hose into a curved section which is retained by the hose, providing a shapeable hose, which shape is retained by the hose during urination.

In presently preferred embodiments, the portable urinal may be provided with a receptacle for receiving urine from a male which is in the form of an enlarged vessel for receiving a glans penis with an offset opening for urine flow. The offset opening is curved downward from the vessel and is in communication with the second end of the corrugated hose. In a presently preferred embodiment, the opening of the enlarged vessel is provided with a soft rubber or resilient rim on its outer edge. The rim is made of a softer material than the vessel.

In another embodiment of the present invention, the portable urinal is provided with a receptacle for receiving urine from a human being which includes a generally elliptical shaped vessel with flattened ends and a substantially crescent curved upper periphery conforming to the shape of a vulva.

In a presently preferred embodiment, the periphery of the vessel is provided with an edge member softer than the vessel and which further conforms to the shape of the vulva when the vessel is held against the vulva.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
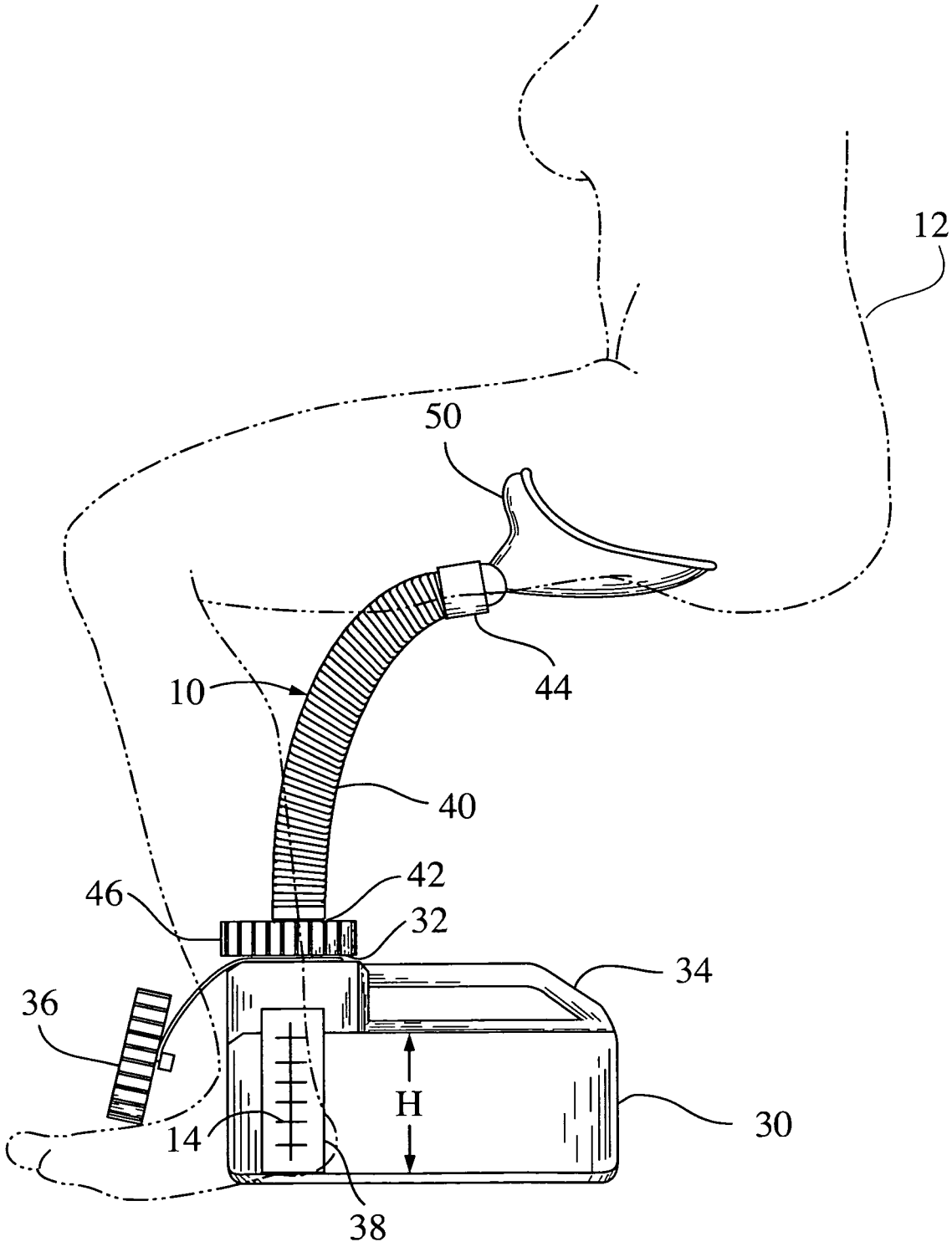
FIG. 1 is a view in perspective of a portable urinal in accordance with the present invention being utilized by a female shown in dotted outline form.
Figure 2:
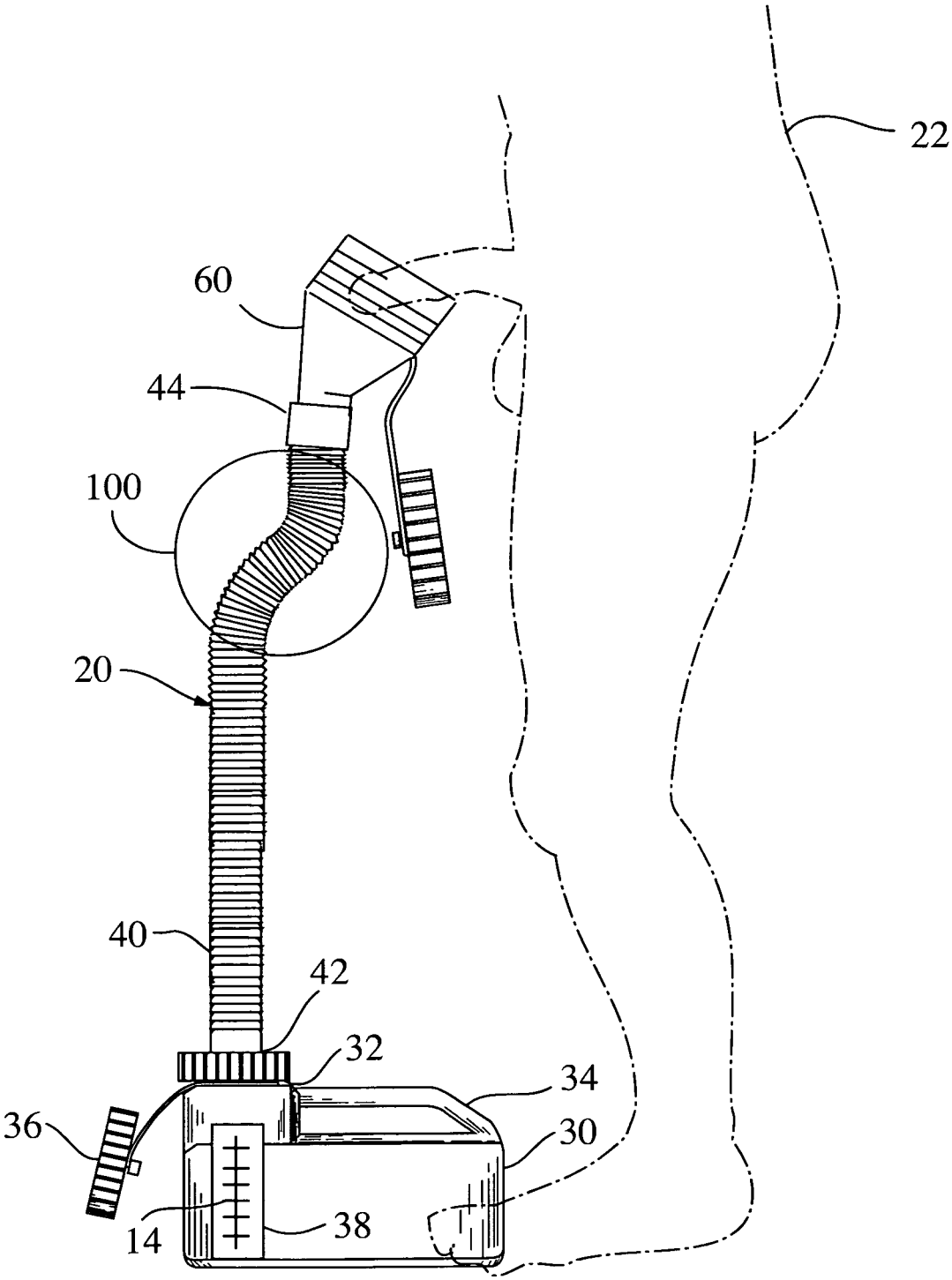
FIG. 2 is a view in perspective of a portable urinal in accordance with the present invention being utilized by a male shown in dotted outline.

Referring now to the drawings, wherein like numerals indicate like elements, there is shown in FIG. 1 a portable urinal 10 being utilized by a female 12. In a similar manner, FIG. 2 shows a portable urinal 20 being utilized by a male 22. Both portable urinals 10 and 20 are the same in that they have a reservoir container 30 and a flexible corrugated hose 40. The reservoir container 30 is provided with a low center of gravity when it contains urine by reason of it being of relatively large cross section with respect to its height or, in other words being shallow. The presently preferred dimensions of reservoir 30 may be a height H as shown on FIG. 1 of approximately two inches, a length of approximately seven inches and a width of approximately three and three quarter inches. However, it is understood that other variations of height length and width may be utilized so long as orthogonal dimensions of the area of the bottom is larger than the height. Further, other shapes may be utilized other than rectangular. However, in the presently preferred embodiment, the shape would be rectangular with dimensions as provided.

Reservoir container 30 is provided with an opening 32 on its upper portion and a handle 34 for ease in positioning and carrying reservoir 30. Input opening 32 is provided with a means for sealing input 36 of input 32 when hose 40 is not connected to input 32. Reservoir 30 is preferably made of an opaque plastic material except for a vertically arranged elongated transparent area 38 on a sidewall of reservoir container 30 for viewing the absence of or the amount of urine in reservoir container 30. Substantially transparent area 38 may be provided with graduations or a scale 14 to measure the amount of urine in the container.

Corrugated hose 40 is provided with a first end 42 and a second end 44. Corrugated hose 40 is flexible, extendable and contractible. Each corrugation of corrugated hose 40 is releasably lockable in a contracted condition and releasably lockable in an extended condition. The corrugations are structured such that the legs of the corrugation are designed such that one leg is slightly longer than the other creating a snapping or locking effect locking the corrugation in either an expanded or contracted condition, and this locking feature is applicable for a radial section of the corrugated hose, thereby enabling the hose not only to be extended or contracted and remain locked in that condition for as long as desired, such as the time duration of urination or the time duration of storage of the portable urinal. Further, since a radial section of each corrugation may be locked in either contracted or expanded condition, the corrugated hose may be curved and retained in that curved condition until moved or forcibly changed. In this manner, the corrugated hose may be lengthened to the desired length and positioned with the desired angles for comfortable urination in either sitting, standing or stooping positions or any other position and the hose will maintain that shape or position during the period of urination. After urination, the hose may be contracted for storage in less space, and the corrugated hose will remain contracted until extended. These features will be discussed hereinafter with respect to FIG. 5.

As described above, since each corrugation of the corrugated hose is releasably lockable in a contracted condition an/or an extended condition, the corrugated hose 40 may be easily adjusted to the desired length without having any coiling or flopping of unnecessary extra hose length. Such coiling, loops or bows of excess hose could be a place of undesirable accumulation of small amounts of urine which may then be unsightly to deal with when the hose is being removed for storage.

First end 42 of corrugated hose 40 is releasably attachable to opening 32 by threaded union or fastener 46. It is understood that other types of fasteners may be utilized other than threaded fasteners, such as snap on fasteners. But in a presently preferred embodiment of the invention, union 46 would be threadable onto opening 32. In other words, union 46 releasably attaches the first end of corrugated hose 40 to input 32 of reservoir container 30 when means for sealing 36 is not on input 32. The second end 44 of corrugated hose 40 is attachable to a receptacle for receiving urine from a human being, such as female receptacle 50 in FIG. 1 and male receptacle 60 in FIG. 2. Female receptacle 50 is shown in greater detail in FIG. 3 and male receptacle 60 is shown in greater detail in FIG. 4.

Figure 3:
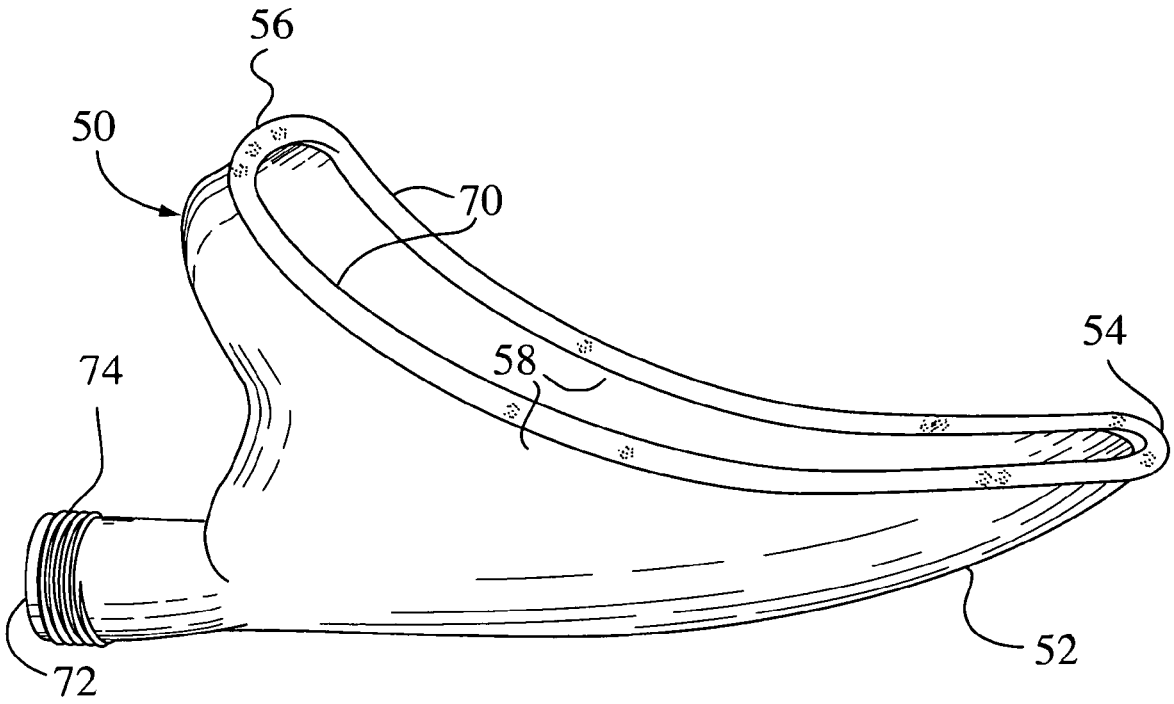
FIG. 3 is a view in perspective of a urine receptacle for use in the embodiment of FIG. 1 by a female.

Referring now to FIG. 3 in connection with FIG. 1, there is shown enlarged view in perspective of a female receptacle 50 comprised of a generally elliptical shaped vessel 52 with flattened ends 54 and 56. The Generally elliptically shaped vessel 52 has a crescent shaped curved periphery 58 which corresponds to the shape of a vulva. The generally elliptically shaped vessel 52 is provided with an output opening 72 which may be threadably connected by means of threads 74 to second end 44 of flexible corrugated hose 40. Preferably, the periphery 58 of elliptical vessel 52 is provided with an edge member 70 made of a softer material than the material from which the vessel is made and which further conforms to the shape of the vulva when the vessel is held against the vulva. This helps prevent leaks and provides comfort in use. Edge member 70 may be made of rubber or other suitable resilient plastic materials which provide a soft edge, softer than the material from which vessel 52 is constructed, which conforms completely to the shape of the vulva when used by a female. Edge member 70 made of a soft, resilient material such as rubber provides both a sealing function between the urinal receptacle and the vulva and provides added comfort to the user.

Figure 4:
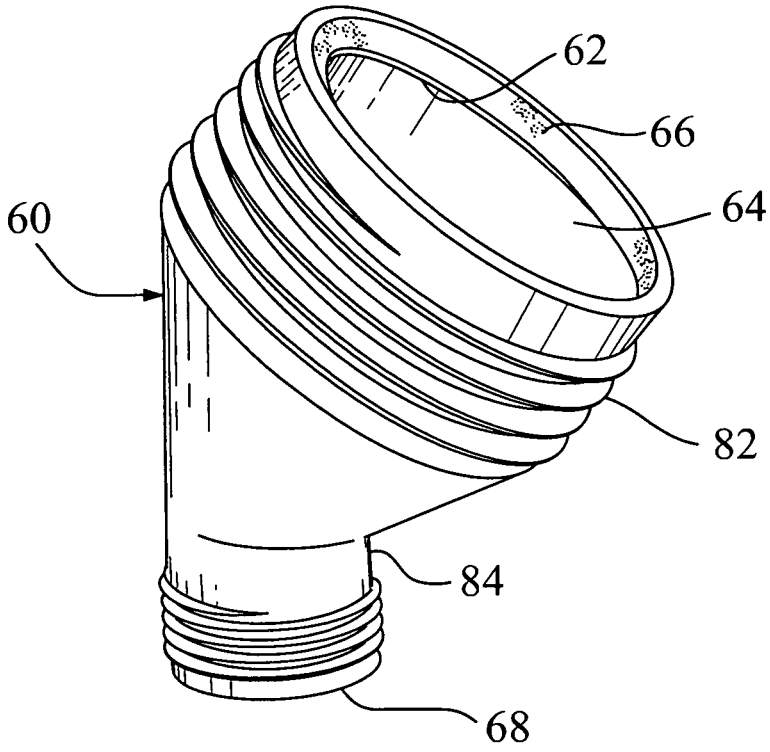
FIG. 4 is a view in perspective of a urine receptacle for use by a male as shown in FIG. 2.

Referring now to FIG. 4 in connection with FIG. 2, there is shown a male receptacle 60 which is comprised of a large offset vessel 62 for receiving the glans penis of a male. The upper or outer edge 64 of vessel 62 is provided with a resilient rim 66 which may be comprised of rubber or other resilient material. This provides an outer or opening edge of vessel 62 which does not irritate or cause discomfort to a male user using receptacle 60. Vessel 62 connects to offset opening 68 which is angled downwardly from enlarged vessel 62 insuring urine flow out of offset opening 68 and into second end 44 of corrugated hose 40. As illustrated in FIG. 2, the offset opening 68 is connected to second end 44 of flexible corrugated hose 40. As illustrated in FIG. 2, male receptacle 60 may be provided with a closure 80 in the form of a threaded cap. Threaded cap 82 may be threadably mounted onto threads 82 illustrated in FIGS. 2 and 4. However, it is understood that other means of securing a closure or cap on the upper end of receptacle 60 may be provided within the scope of the present invention.

The angle 84 at the junction of offset output 68 and the vessel 62 for receiving urine from the glans penis is important for insuring that the urine empties completely into flexible corrugated hose 40 and does not back flow onto the user.

Figures 5, 5A:
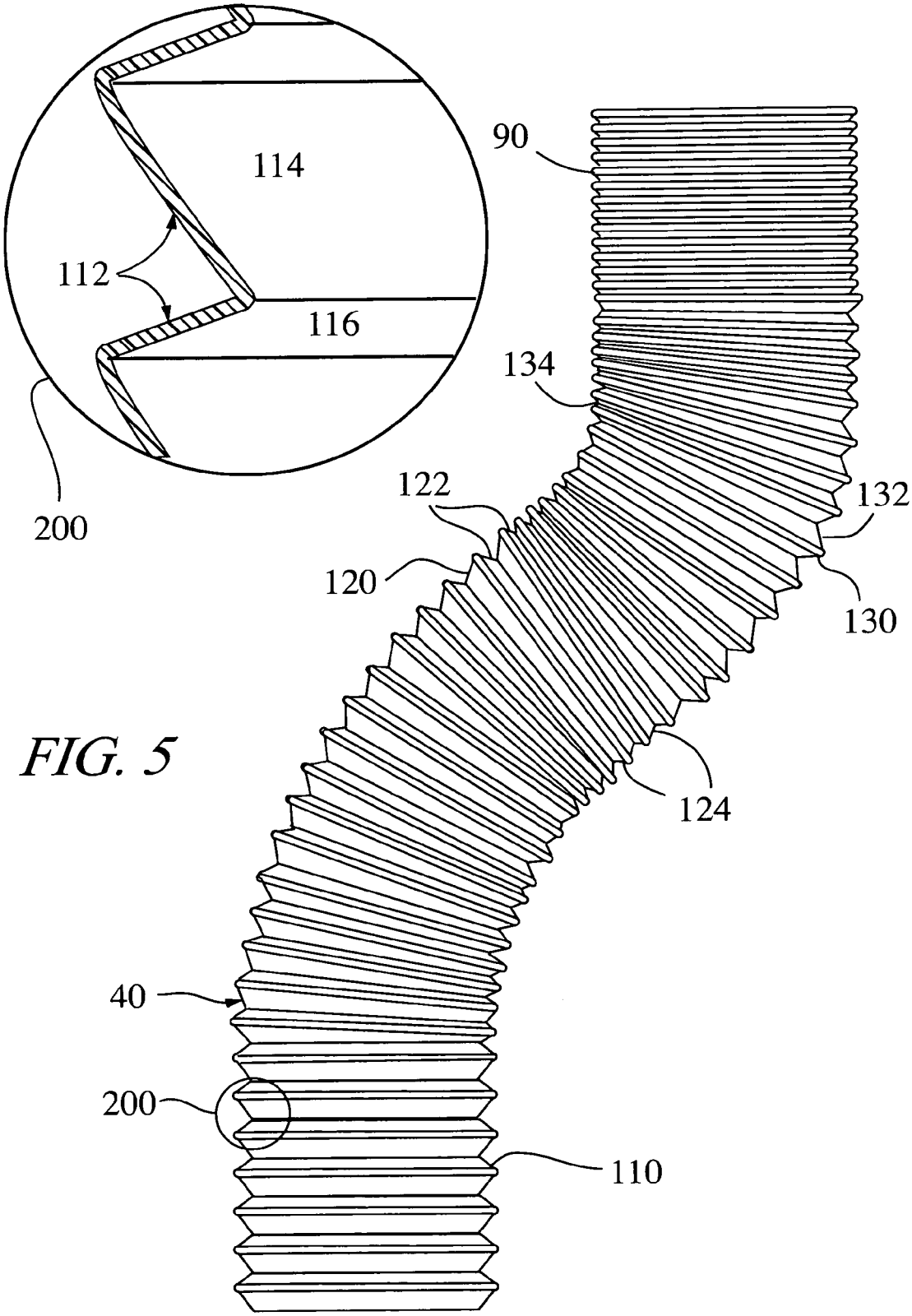
FIG. 5 is an elevation view of a portion of flexible corrugated hose 40 in the area identified at 100 in FIG. 2.
FIG. 5A is an enlarged cross sectional view taken in the area identified as 200 in FIG. 5.

Referring now to FIG. 5, there is shown an enlarged elevation view of the portion of flexible corrugated hose 40 shown in the area defined as 100 in FIG. 2. FIG. 5A is an enlarged cross sectional view of the area of FIG. 5 shown in circle 200 in FIG. 5. As may be seen in FIG. 5, portion identified at 90 of hose flexible corrugated hose 40 illustrates the flexible corrugated hose 40 in its contracted position where it is retained in its contracted position or shortened condition. Area 110 of hose 40 illustrates flexible corrugated hose 40 in its extended position. In both cases, in the case of the contracted corrugations of 90 and in the expanded or extended corrugations shown at 110, the hose is retained in that condition by the structure of the corrugated hose itself. This is due in part to the structure of the flexible corrugated hose wherein the two legs of a corrugation are of different length causing a snap type locking condition when the hose is forced into its compressed position or forced into its extended position. As illustrated best in FIG. 5A, it may be seen that there is shown a corrugation 112 which is comprised of a longer leg 114 and a shorter leg 116.

The entire 360 degrees of a corrugation does not need to be in the same contracted or expanded condition. In other words, a radial section, such as 180 degrees of a corrugation may be in its contracted position or condition and a diametrically opposite or opposing radial section may be in its expanded condition. For example, looking at area 120 of hose 40, there is shown expanded corrugations 122 and contracted corrugations 124 causing the flexible corrugated hose to be retained or locked in a condition of a turn wherein as illustrated in FIG. 5, hose 40 is bent to the right in area 120 and is retained in that bent position.

In a similar manner, there is another curve or turn or bend in flexible corrugated hose 40 at area 130 wherein corrugations are expanded on the right hand side, or the radial section comprised of approximately 180 degrees on the right hand side of FIG. 5 is expanded and contracted corrugations at 134 on the left hand side to create a curve, bend or turn which is locked in or retained until forced otherwise. In other words, corrugated hose 40 is provided with a plurality of corrugations which are flexible, extendable and contractible for at least a radial section portion of the corrugated hose such that the hose may be deformed or curved and the lockable corrugations will retain the hose in a curved shape.

The present invention may be embodied in other specific forms without departing from the spirit or essential attributes thereof and, accordingly, reference should be made to the appended claims, rather than to the foregoing specification as indicating the scope of the invention.

I claim:

1. A portable urinal kit, comprising:

a container for holding urine, the container having an input configured to receive or dispose urine;

a sealing member configured to releasably attach to the input;

a female receptacle configured to receive urine from a female human being in either a seated or a standing position;

a male receptacle configured to receive urine from a male human being in either a seated or a standing position; and a flexible hose having a first end and a second end disposed opposite the first end, the first end configured to releasably attach to the input, and the second end configured to releasably receive the male receptacle or the female receptacle.

2. The portable urinal of claim 1, wherein the male receptacle includes an enlarged vessel for receiving the glans penis with an offset opening for urine flow, the offset opening being curved downward from the enlarged vessel and being in communication with the second end of the flexible hose.

3. The portable urinal of claim 2, wherein the offset opening of the enlarged vessel for receiving the glans penis is provided with a rubber rim on its outer edge.

4. The portable urinal of claim 1, wherein the female receptacle includes a generally elliptically shaped vessel with flattened ends and a curved upper periphery conforming to a shape of a vulva.

5. The portable urinal of claim 4, wherein the female receptacle is constructed of a plastic material.

6. The portable urinal of claim 5, wherein the curved upper periphery further comprises an edge member that is constructed of a material that is softer than the plastic material, and wherein the edge member further conforms to the shape of the vulva when the vessel is held against the vulva.

7. The portable urinal of claim 6, wherein the edge member is constructed of rubber.

8. The portable urinal of claim 1, wherein the container is provided with a rectangular base and the length and width of the base is greater than the height of the container.

9. The portable urinal of claim 1, wherein the flexible hose further comprises a plurality of corrugations which are flexible, extendable and contractible for at least a radial section portion of the flexible hose such that the flexible hose may be deformed or curved and the plurality of corrugations will retain the flexible hose in a curved shape.

* * * * *